US005945779A

United States Patent [19]

Inoue et al.

[11] Patent Number: 5,945,779

[45] Date of Patent: Aug. 31, 1999

[54] SPLIT TYPE DEFLECTION COIL SEPARATOR FOR AVOIDING AXIAL DEVIATION AND ECCENTRICITY

[75] Inventors: Tomomi Inoue; Toshinori Sasaki, both of Fukushima, Japan

[73] Assignee: Sony Corporation, Tokyo, Japan

[21] Appl. No.: 08/984,065

[22] Filed: Dec. 3, 1997

[30] Foreign Application Priority Data

Dec. 19, 1996 [JP] Japan ..... P08-339966

[51] Int. Cl.[6] ..... H01F 7/00; H01F 5/02

[52] U.S. Cl. ..... 313/440; 335/210; 335/213

[58] Field of Search ..... 313/440; 335/210, 335/213, 296

[56] References Cited

U.S. PATENT DOCUMENTS 5,557,165 9/1996 Descombes et al. ..... 335/210

5,838,098 11/1998 Takagishi ..... 313/440

*Primary Examiner*—Sandra O'Shea

*Assistant Examiner*—Joseph Williams

*Attorney, Agent, or Firm*—Jay H. Maioli

[57] ABSTRACT

A split type coil separator which does not easily generate axial deviation, is formed as a split type coil separator which is composed of a neck portion side coil separator and a funnel portion side coil separator. A coupling structure is provided at the contact surfaces of the neck portion side coil separator and funnel portion side coil separator. The coupling structure is composed of a neck portion side coupling portion and a funnel portion side coupling portion. A pair of coupling projections are provided at the positions opposed by almost 180 degrees in the neck portion side coupling portion, while a coupling recessed portion is formed to the internal circumference surface corresponding to the coupling projections. When both coil separators are coupled and fixed by this coupling structure, respective coil separators are integrated without generation of axial deviation and eccentricity of center axes. Thereby, predetermined deflecting condition can be realized and the deflection adjusting work can also be eliminated.

5 Claims, 9 Drawing Sheets

FRONT

SPLIT TYPE DEFLECTION COIL SEPARATOR FOR AVOIDING AXIAL DEVIATION AND ECCENTRICITY

BACKGROUND OF THE INVENTION

1. Field of the Invention

The present invention relates to a split type coil separator which is suitable for application into a deflection device of a cathode ray tube apparatus. In more detail, a coil separator which is formed by winding a horizontal deflection coil is constituted as a split type separator, a coupling means is provided at the contact surfaces of a pair of split coil separators and both coil separators are coupled and fixed using this coupling means so that the center axes of both coil separators coupled are perfectly aligned with each other to obtain stabilized deflection characteristic.

2. Description of the Related Art

A deflection device used in a cathode ray tube (CRT) is structured as shown in FIG. 12. In this figure, a funnel type coil separator 12 is provided, as is well known, with a horizontal deflection coil (not illustrated) in its internal circumference surface side and a vertical deflection yoke 14 at its external circumference surface side.

The vertical deflection yoke 14 is also shaped like a funnel and is also provided with the deflection coils at its internal and external circumference surfaces to form as a whole the deflection device 10 for deflecting electron beams in the horizontal and vertical directions.

In the case of using an integrated type structure as shown in the figure as a coil separator 12, a deflection yoke 14 must be inserted onto the external side of this coil separator 12 to form the integrated structure as shown in FIG. 12. For this purpose, the internal diameter of the deflection yoke 14 must be larger than the external diameter of a bending portion 13*a* provided at the neck portion of the coil separator 12. The bending portion 13*a* is usually structured with a flange which is sufficiently larger than the internal diameter of the coil separator 12 in order to wind the horizontal deflection coil.

Therefore, if the internal diameter of the deflection yoke 14 is formed matching with the external diameter of the bending portion 13*a*, when the deflection yoke 14 is loaded to the external circumference surface of the coil separator 12, a considerable gap W is generated against the external circumference surface of the coil separator 12 as shown in the same figure.

When the gap W is large, the vertical deflection efficiency is as much lowered. Therefore, it is required to apply a considerably large vertical deflection current to the vertical deflection coil (not illustrated).

Therefore, the vertical deflection efficiency may be improved by reducing the gap W as much as possible. An example of the related art of the coil separator 12 proposed for this purpose is shown in FIG. 13. Namely, as shown in FIG. 13, the coil separator 12 itself has been formed as the split type coil separator which may be divided into the front and rear portions.

That is, the coil separator 12 is formed of a neck portion side coil separator 12A and a funnel section side coil separator 12B and the vertical deflection yoke 14 to which a vertical deflection coil is wound under the condition that the neck portion side coil separator 12A is isolated is loaded to the external circumference surface of the funnel portion side coil separator 12B.

Since the bending portion 13*a* is not an obstacle for this loading, the internal surface of the deflection yoke 14 can be formed conforming to the shape of the external circumference surface of the funnel portion side coil separator 12B. Accordingly, a gap W between the coil separator 12B and deflection yoke 14 can be reduced to only a very small value.

Thereafter, the neck portion side coil separator 12A is coupled as shown in FIG. 13 and the horizontal deflection coil is wound to the internal surface of the coil separator 12 under this condition. In view of assuring better loading condition of the vertical deflection yoke 14 for the coil separator 12, the hooks 16*a*, 16*b* are formed respectively to the bending portions 13*a*, 13*b* for engagement with the deflection yoke in the example of FIG. 13. Thereby, the deflection yoke 14 may be fixed.

Accordingly, since a gap between the coil separator 12 and deflection yoke 14 can be reduced, the deflection efficiency of the vertical deflection coil can be improved remarkably over that of FIG. 12.

Meanwhile, when the coil separator 12 is formed like a split type coil separator, the horizontal deflection coil is generally wound under the condition that the end surfaces of both coil separators 12A, 12B are placed in contact with each other after the deflection yoke 13 is loaded.

Accordingly, when the horizontal deflection coil is wound, the center axis L*a* of the neck portion side coil separator 12A is sometimes not aligned with the center axis L*b* of the funnel portion side coil separator 12B and a deviation ΔL is generated due to a coil winding force or holding force of the deflection yoke 14 by means of hooks 16*a*, 16*b*.

If such axial deviation ΔL and eccentricity are generated, the predetermined distribution of deflection magnetic field cannot be obtained and in the worst case, it will be required to compensate for the deflection magnetic field. Therefore, careful deflection adjustment work is always required.

SUMMARY OF THE INVENTION

The present invention has solved the problems of the related art as explained above and proposes a split type coil separator which does not easily generate axial deviation and eccentricity.

In order to solve the problems explained above, of the present invention is a split type coil separator formed of a neck portion side coil separator and a funnel portion side coil separator, characterized in providing a coupling means between the coupling surfaces of the neck portion side coil separator and funnel portion side coil separator to couple and fix the respective coil separators so that the center axes of both coil separators are aligned with each other.

In the present invention, a coupling means is provided at the coupling surfaces of the neck portion side coil separator and the funnel portion side coil separator. The coupling means is provided to both the neck portion side and funnel portion side. When both coil separators are coupled with this coupling means, the center axis L*a* of the neck portion side coil separator is aligned with the center axis L*b* of the funnel portion side coil separator and thereby when the horizontal deflection coil is wound, any axial deviation or eccentricity will not be generated. Accordingly, good deflection can be realized.

BRIEF DESCRIPTION OF THE DRAWINGS

Other objects and advantages of the present invention will be apparent from the following detailed description of the presently preferred embodiment thereof, which description should be considered in conjunction with the accompanying drawings in which.

DESCRIPTION OF THE PREFERRED EMBODIMENT

Application of an embodiment of the split type coil separator of the present invention into a deflection device will be explained in detail with reference to the accompanying drawings.

Figure 1:
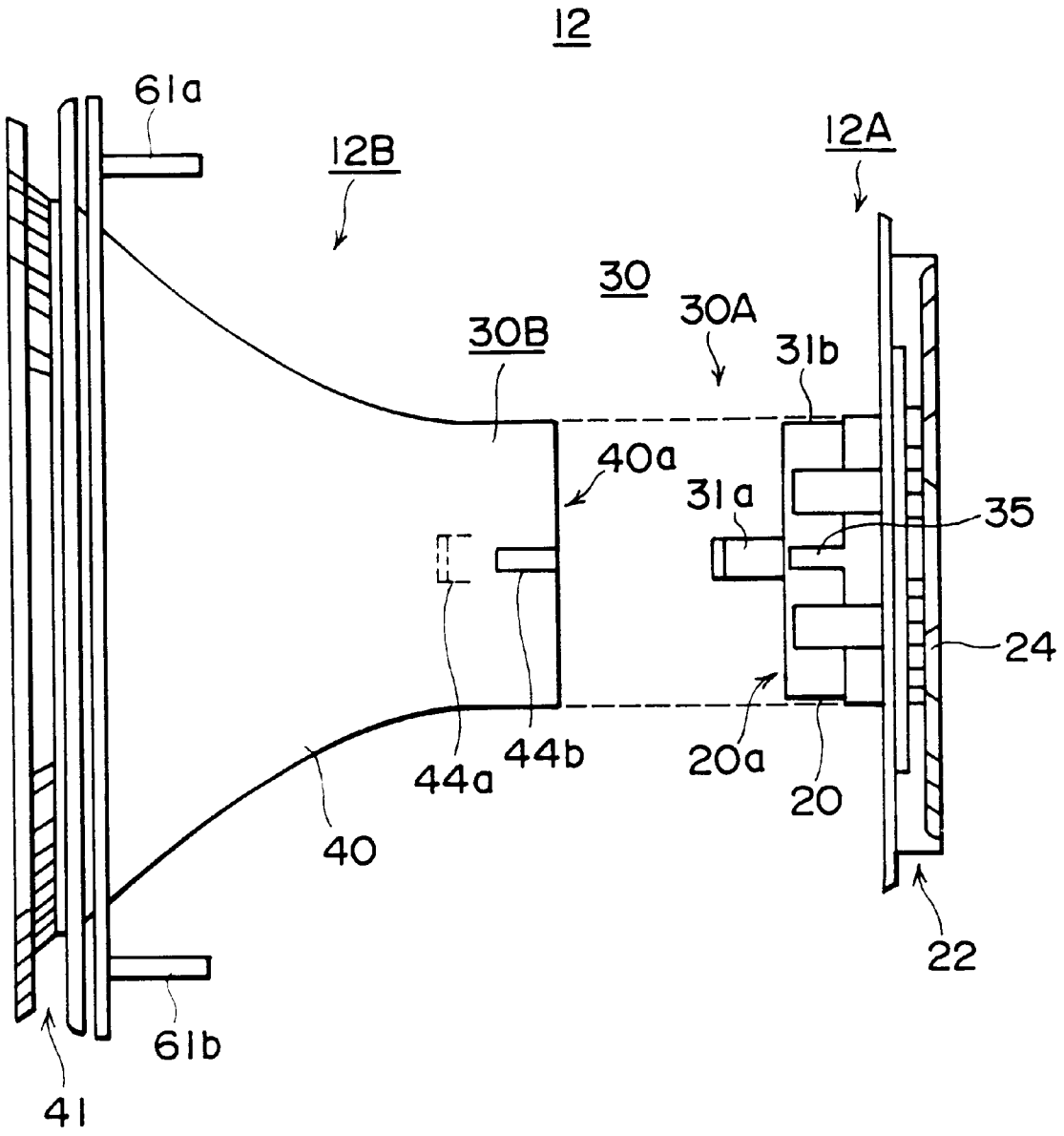
FIG. 1 is a plan view showing an embodiment of a split type coil separator of the present invention.

FIG. 1 shows an embodiment of the split type coil separator of the present invention. This split type coil separator is divided into the ⅓ portion and ⅔ portion of the axial length. One is defined as the neck portion side coil separator 12A and the other as the funnel portion side coil separator 12B. These split type coil separators 12A, 12B are respectively provided, at the contact end surfaces 20*a*, 40*a*, with a coupling means 30 for integrating these coil separators 12A, 12B.

Figure 2C:
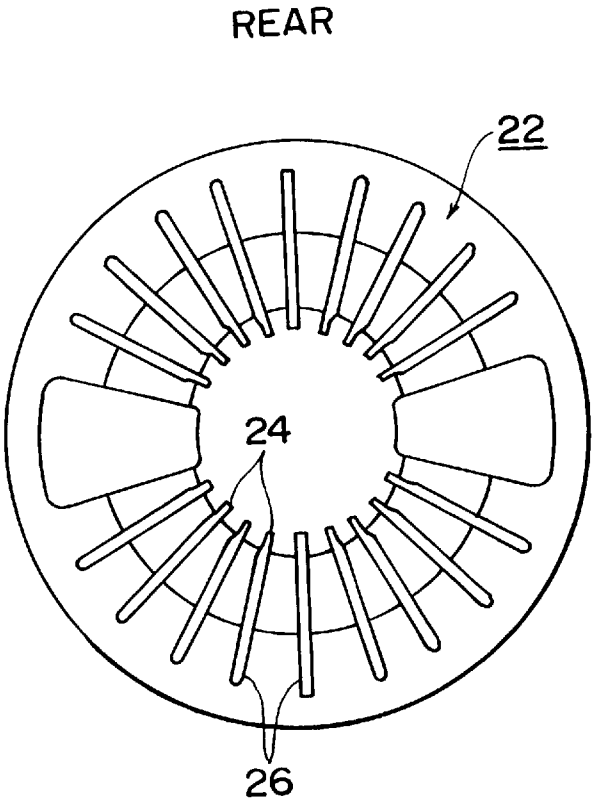
FIG. 2 is a side view, a front view and a rear view showing an embodiment of the neck portion side coil separator.
Figure 2A:
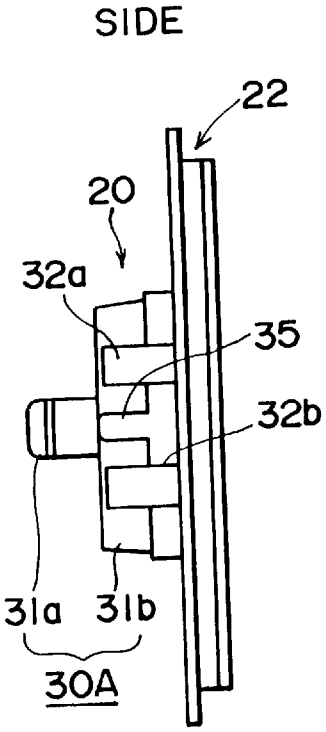
Figure 2B:
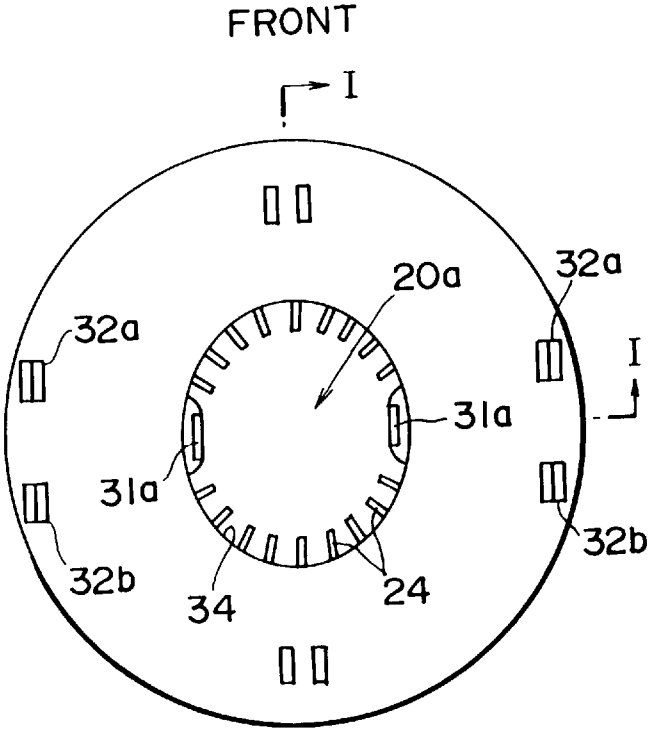

The neck portion side coil separator 12A will be explained first. This coil separator 12A is composed, as shown in FIG. 1 and FIG. 2B, of a cylindrical portion 20 having the semi-circular cross-sectional view and a bending portion 22 formed in the rear view side thereof. A horizontal deflection coil (not illustrated) is wound between a plurality of ribs 24 (FIG. 2B) formed at the internal surface of the cylindrical body 20 and a plurality of L-shaped hooks 26 formed in the side of the bending portion 22.

Figure 3:
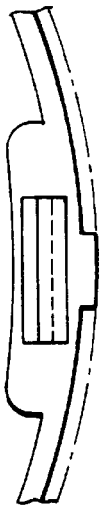
FIG. 3 is a diagram showing relationship between a coupling projection and a coupling protruded portion.

A neck portion side coupling portion 30A forming a coupling means 30 is provided in the side of the contact end surface 20*a* of the cylindrical body 20. This coupling portion 30A is provided with a pair of hook type coupling projections 31*a* in such a manner as being projected from the contact end surfaces 20*a* in the right and left sides as shown in FIGS. 2A to 2C and the contacting external circumference surface 31*b* having the external diameter a little larger than that of the cylindrical body 20 is formed in the side of the contact end surface 20*a* of the cylindrical body 20. The contacting internal circumference surface 31*b* in the same position as the coupling projection 31*a* allows formation of a guide projection (coupling projection) 35 (refer to FIG. 3). It will be explained later in detail.

Figure 4:
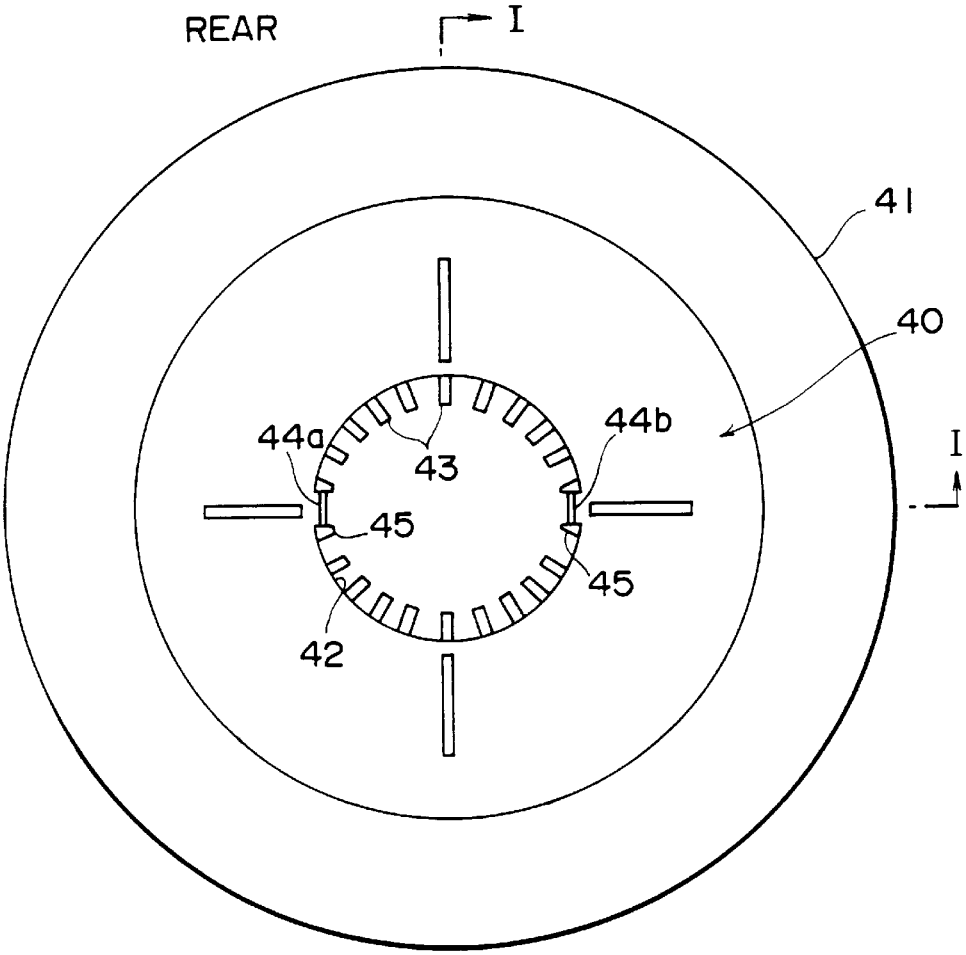
FIG. 4 is a rear view of the funnel portion side coil separator.
Figure 5:
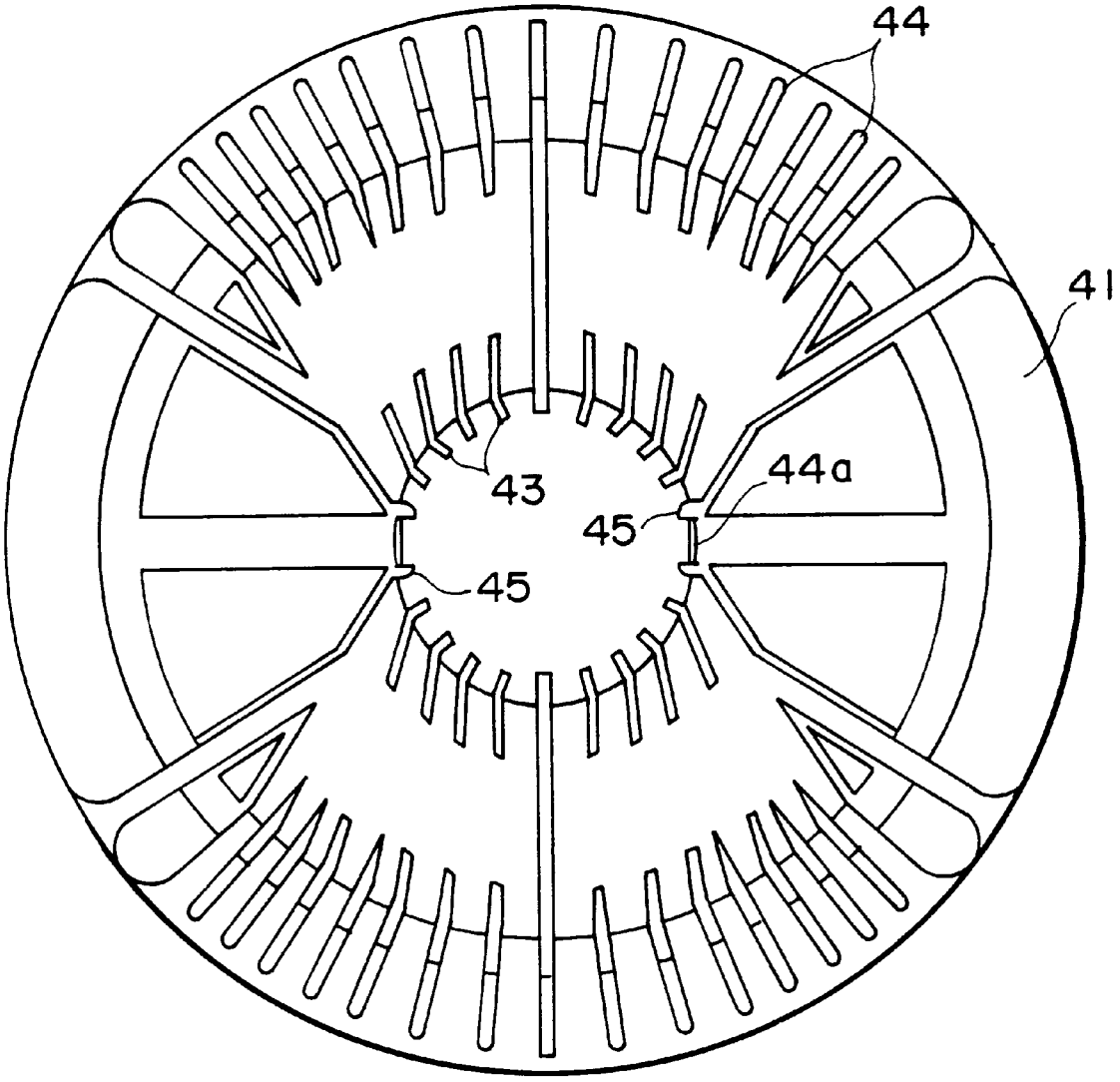
FIG. 5 is a front view of the funnel portion side coil separator.

The funnel portion side coil separator 12B shown in FIG. 1 is composed of a funnel shape body 40 and a bending portion 41 provided in the front side thereof. As shown in FIG. 4, a plurality of ribs 43 are formed at the internal surface 42 and a plurality of L-shape hooks 44 are formed as shown in FIG. 5 in the corresponding bending portion 41. The horizontal deflection coil is wound in the internal surface of the body by making use of these ribs 43 and hooks 44.

As shown in FIG. 1, a funnel portion side coupling portion 30B is provided in the side of the contact surface 40*a* of the body 40. This coupling portion 30B corresponds to the neck portion sidecoupling portion 30A. Therefore, a coupling recessed portion (coupling stepped portion) 44*a* (refer to FIG. 5) is formed to the predetermined position at the internal surface 42 of the body 40 and an engaging recessed portion (cutout portion) 44*b* is provided to the position corresponding to the guide projection 35.

Figure 6:
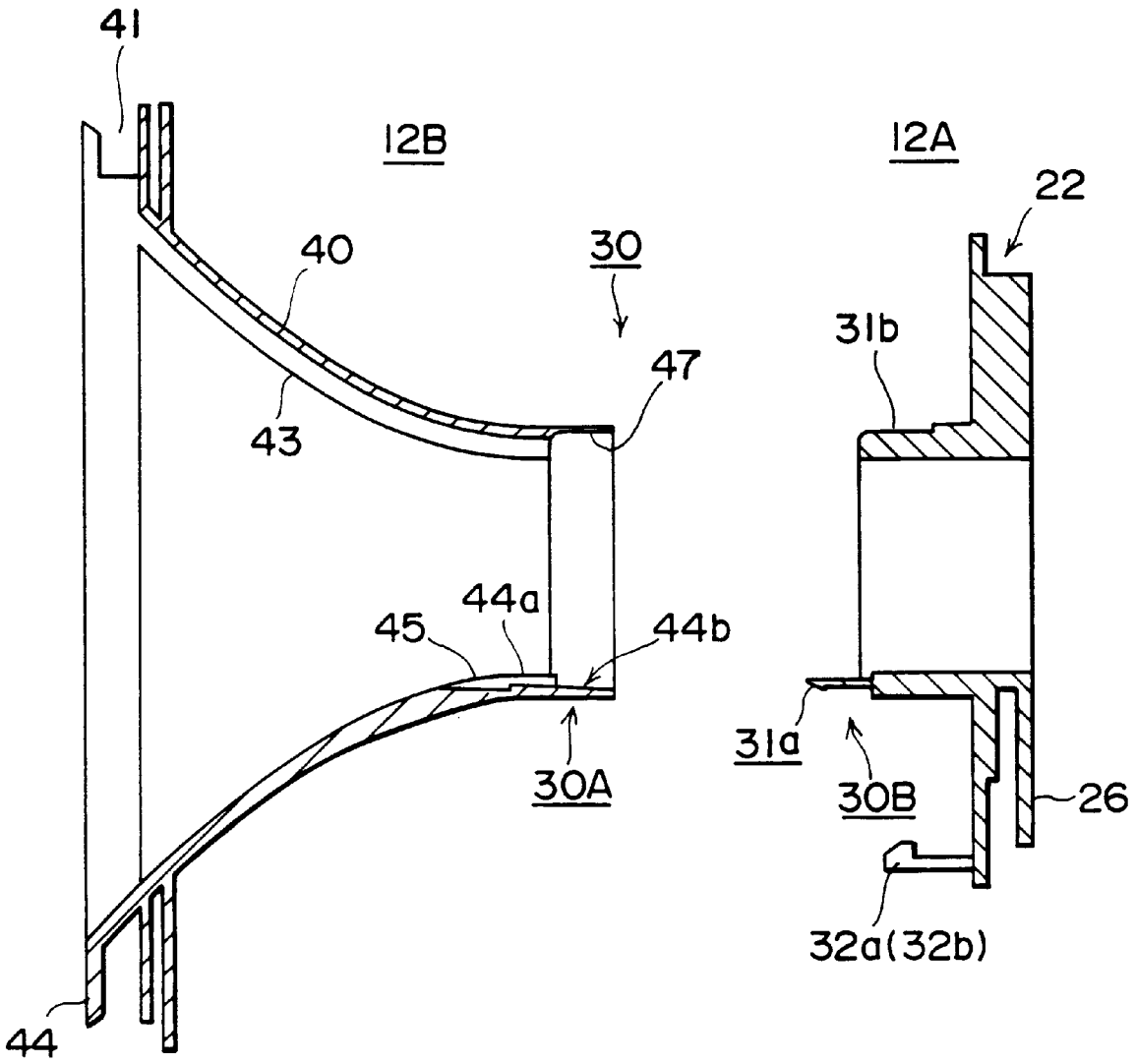
FIG. 6 is a diagram showing the cross-sectional view of the split type coil separator when it is cut along the line I—I in FIG. 2 and FIG. 4.

Moreover, as shown in FIG. 6, a contact internal circumference portion 47 which is to be in contact with the contact external circumference surface 31*b* is formed in the internal circumference surface side of the contact end surface 40*a* side.

Figure 7:
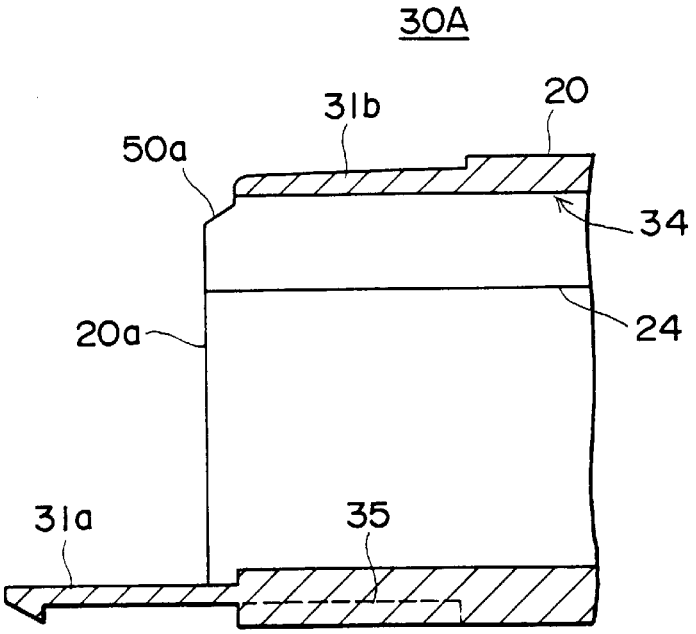
FIG. 7 is a cross-sectional view showing details of the neck portion side coupling portion.

FIG. 6 shows a cross-sectional view on the line I—I of FIG. 2B and FIG. 4, while FIG. 7 shows details of the neck portion side coupling portion 30A. As seen in FIG. 7, the contact external circumference surface portion 31*b* is formed to be a little inclined toward the contact end surface 20*a* side. A stepped portion 50*a* as shown in the figure is formed at a part of the contact end surface 20*a* to assure the accurate contact.

As shown in FIGS. 2A and 2B, a plurality of hooks, that is, four hooks 32*a*, 32*b* in total in the right and left sides, in this example, are provided at a part of the bending portion 22 toward the funnel portion side coil separator 12B, but these hooks 32*a*, 32*b* are used, like the related art, to fix the vertical deflection yoke 14 to be loaded to the external circumference surface of the coil separator 12. For instance, the holding pins 61*a*, 61*b* , shown in FIG. 1 are provided in the side of the funnel portion side coil separator 12B in place of the hooks. The holding pins 61*a*, 61*b* hold the external circumference surface of the vertical deflection yoke 14.

Figure 8:
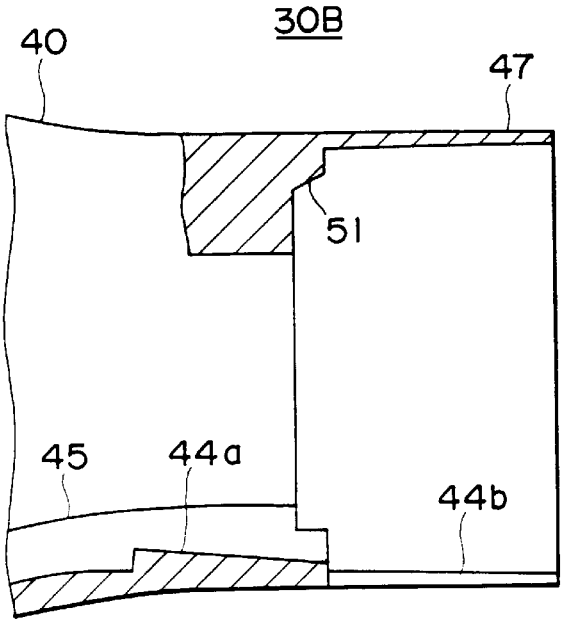
FIG. 8 is a cross-sectional view showing details of the funnel portion side coupling portion.

FIG. 8 shows a detail of the funnel portion side coupling portion 30B. A pair of guides 45 (refer to FIG. 5) are provided to the coupling recessed portion 44*a* in both sides thereof to guide the coupling projection 31*a* so that the coupling projection 31*a* can be guided smoothly toward the coupling recessed portion 44*a*. The coupling internal circumference surface 47 is also inclined corresponding to the coupling external circumference surface 31*b* and the stepped portion 51 is provided to be closely in contact with the stepped portion 50*a*.

Figure 9:
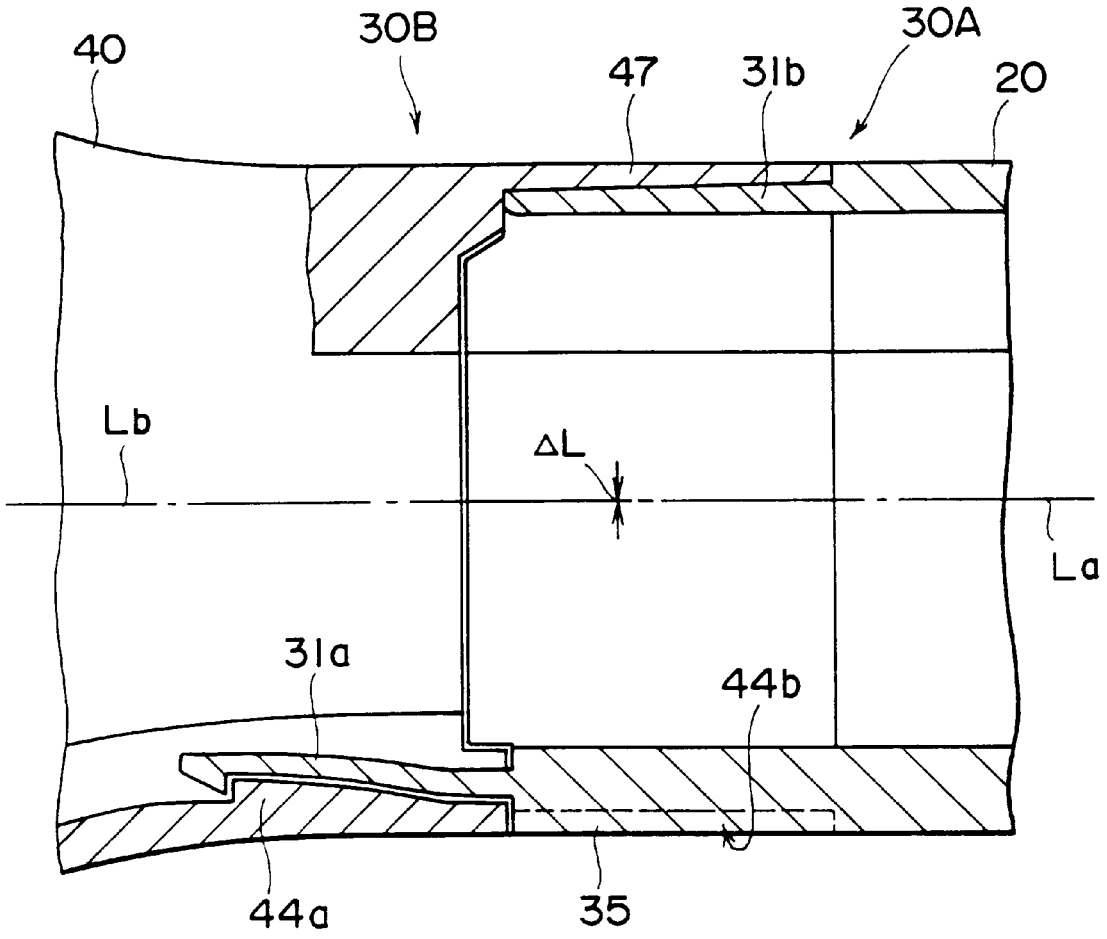
FIG. 9 is a cross-sectional view of the coupling condition.

Therefore, the neck portion side coupling portion 30A is slid until it is coupled with the funnel portion side coupling portion 30B to provide the condition shown in FIG. 9. In this case, the forming position of the coupling projection 31*a* is selected so that the coupling projection 31*a* is engaged with the coupling recessed portion 44*a* under the condition that it is a little deflected.

Figure 10:
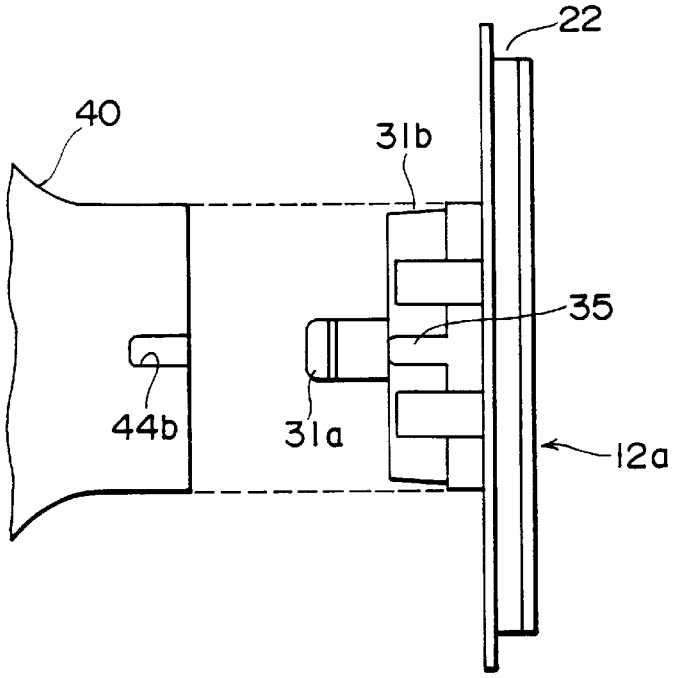
FIG. 10 is a diagram showing the condition before coupling indicating relationship of the coupling projection.
Figure 11:
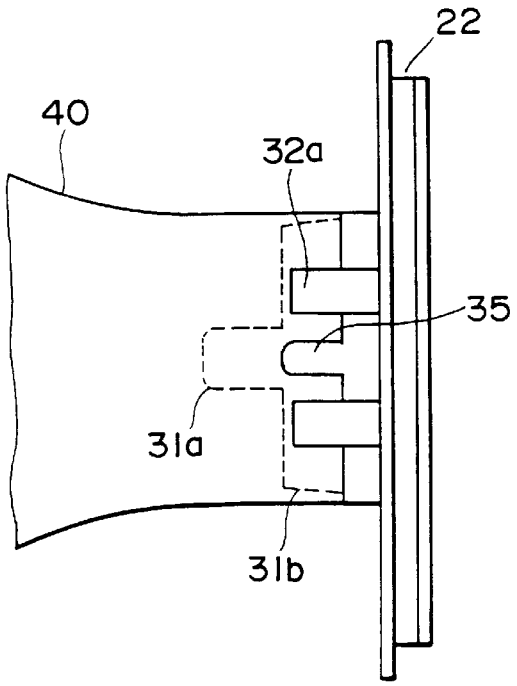
FIG. 11 is a diagram showing the condition after coupling indicating relationship between the coupling protruded portion and coupling recessed portion.
Figure 12:
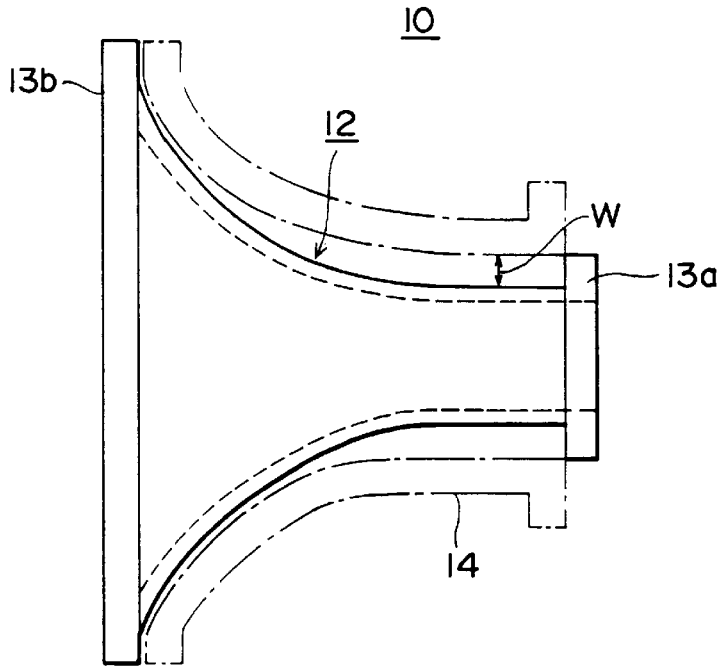
FIG. 12 (PRIOR ART)
FIG. 12 is a diagram for explaining a deflection device of the related art.
Figure 13:
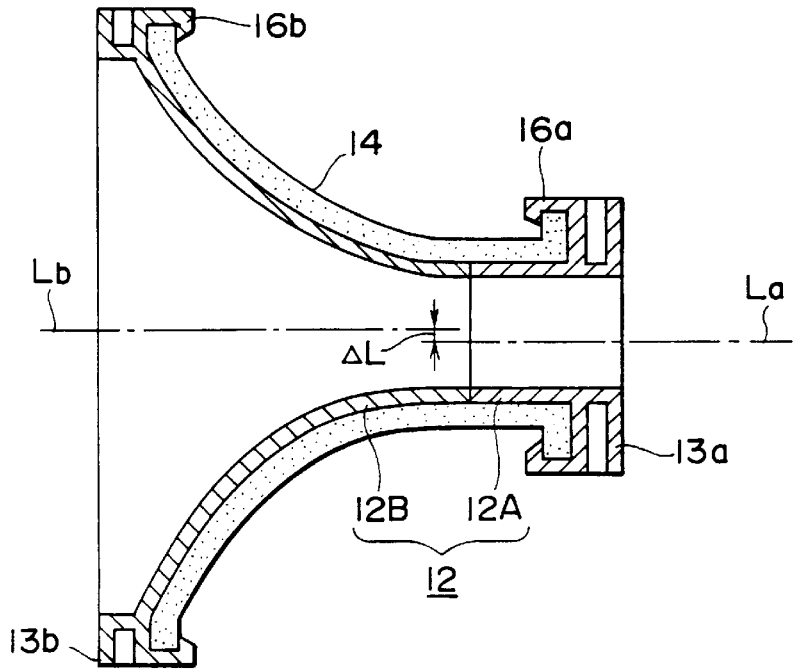
FIG. 13 (PRIOR ART)
FIG. 13 is a diagram for explaining a deflection device using the split type coil separator of the related art.

With an elastic force by coupling of the coupling projection 31*a*, relationship with the coupling internal and external circumference surfaces 31*b*, 47, relationship between the engaging projection 35 and engaging recessed portion 44*b* and cooperation of stepped portions 50*a*, 51 explained previously, the neck portion side coil separator 12A and funnel portion side coil separator 12B are rigidly coupled and fixed with each other. In this case, the engaging projection 35 shown in FIG. 10 is engaged with the engaging recessed portion 44*b* to provide the condition shown in FIG. 11 and therefore the coil separators 12A and 12B are rigidly coupled and fixed also in the circumference direction.

Here, the molding (molding by resin) is executed after selecting the sizes of both coil separators 12A and 12B so that the coupling as explained above assures almost perfect matching between the center axis L*a* of the neck portion side coil separator 12A and the center axis L*b* of the funnel portion side coil separator 12B. Namely, alignment of both center axes L*a* and L*b* can be made by coupling between the external circumference surface 31*b* and internal circumference surface 47 and the coupling position of the coil separator 12B for the coil separator 12A can be restricted accurately by the coupling projection 31*a* and coupling recessed portion 44*a* and by the engaging projection 35 and engaging recessed portion 44*b*. As a result, axial deviation ΔL and eccentricity of the center axes are almost never generated.

Moreover, since depth of the contact condition is perfectly restricted through contact between the stepped portions 50*a* and 51, there is no fear of change of total length of the coil separator due to the assembling work.

The horizontal deflection coil is automatically wound using a coil winding machine (not illustrated) after both coil separators 12A and 12B are assembled as shown in FIG. 9, but the contact condition of the coupling portions 30A and 30B is never changed even with a force which is applied to the coil separators 12A and 12B during such coil winding operation. This is because displacement by an external force is restricted by the coupling internal and external circumference surfaces 31*b*, 47.

In the case of forming a deflection apparatus 10 using this coil separator 12, the vertical deflection yoke 14 in which a saddle type or toroidal type vertical deflection coil is wound is loaded in the external circumference side of the funnel portion side coil separator 12B. Thereafter, the neck portion side coil separator 12A is coupled and fixed to the funnel portion side coil separator 12B. Thereafter, the horizontal deflection coil is wound, as explained previously, in the manner of the related art using the ribs and hooks to provide the predetermined distribution of magnetic field at the internal surface of the coil separator 12.

As explained previously, in the present invention, a coupling means is provided respectively at the contact surfaces of the neck portion side coil separator and the funnel portion side coil separator and this coupling means realizes coupling and fixing to provide matching of the center axes of respective coil separators.

According to the present invention, since both neck portion side coil separator and funnel portion side coil separator are rigidly coupled and fixed with each other by the coupling means, even if the deflection coil is wound after the coupling, axial deviation and eccentricity will never be generated. Therefore, the present invention provides the effects that the predetermined deflecting condition can be realized and the deflection adjustment work required can be eliminated.

Even in the case of the split type coil separator, it can be loaded only by coupling and when it is once coupled, a deflection apparatus can be completed only with the automatic coil winding process and when the split type coil separator is used, the assembling work is never increased in the assembling steps.

Accordingly, the present invention can be effectively applied to the deflection apparatus of a computer, television receiver or image monitor utilizing a cathode ray tube.

What is claimed is:

1. A split type coil separator comprising:

a neck portion side coil separator;

a funnel portion side coil separator; and a coupling means provided at respective contact surfaces of said neck portion side coil separator and funnel portion side coil separator for coupling and fixing said neck portion side coil separator and said funnel portion side coil separator to each other so that respective center axes of the neck portion side coil separator and said funnel portion side coil separator are aligned, wherein said coupling means comprises a neck portion side coupling portion having a pair of coupling projections provided at positions opposed by 180 degrees, a contact external circumference surface, a neck portion side stepped portion formed at a part of the contact surface of the neck portion side coil separator, and a guide projection, and a funnel portion side coupling portion having a pair of coupling recessed portions formed at an internal circumference surface corresponding to said pair of coupling projections, a contact internal circumference surface at the internal circumference surface corresponding to said contact external circumference surface, a funnel portion side stepped portion provided to be in close contact with the neck portion side stepped portion, and an engaging recessed portion provided at a position corresponding to the guide projection.

2. The split type coil separator according to claim 1, further comprising means adapted for winding a horizontal deflection coil thereon.

3. The split type coil separator according to claim 1, wherein a pair of guides are provided to each coupling recessed portion on both sides thereof, so that the pair of coupling projections are guided smoothly towards the pair of coupling recessed portions.

4. The split type coil separator according to claim 1, wherein the contact external circumference surface is inclined away from the contact surface of the neck portion side coil separator.

5. The split type coil separator according to claim 4, wherein the contact internal circumference surface is inclined to fit with the contact external circumference surface.

* * * * *